US005215398A

United States Patent [19]

White et al.

[11] Patent Number: 5,215,398

[45] Date of Patent: Jun. 1, 1993

[54] INVESTOR DOCUMENT CARRYING FOLDER

[76] Inventors: Mallory A. White; Linda A. McDowell, both of 2725 Camino Artesano, Sante Fe, N. Mex. 87505

[21] Appl. No.: 792,684

[22] Filed: Nov. 15, 1991

[51] Int. Cl.[5] ..... B42F 13/00

[52] U.S. Cl. ..... 402/73; 402/70; 281/31

[58] Field of Search ..... 402/73, 70, 75, 80 P, 402/8, 60; 281/29, 31

[56] References Cited

U.S. PATENT DOCUMENTS

| | | | |
|---|---|---|---|
| 3,221,751 | 12/1965 | Brandon | 402/75 X |
| 4,164,085 | 8/1979 | Steeb et al. | 281/31 X |
| 4,296,945 | 10/1981 | Pavlik . | |
| 4,314,635 | 2/1982 | Fraser et al. . | |
| 4,515,493 | 5/1985 | Radovich | 402/70 X |
| 4,744,689 | 5/1988 | Sternberg | 281/29 X |
| 4,890,728 | 1/1990 | Grimsley . | |
| 4,964,656 | 10/1990 | Prentice . | |

*Primary Examiner*—Mark Rosenbaum
*Assistant Examiner*—Willmon Fridie, Jr.
*Attorney, Agent, or Firm*—Robert W. Harris

[57] ABSTRACT

A notebook type investor document carrying folder, for an investor to organize, file, keep and carry a variety of financial documents needed in investment decision making, accounting and counseling, having three folding sections with flip-up pocket pages attached to each of the outer section interior surfaces, with labels for various categories of documents, and another labelled folder for account statements attached to the interior surface of the central section. The exterior surface of the device bears upon the front cover and spine the printed name of the financial institution which provides the device to customers, and a transparent business card pocket. The investment year may also be printed upon the spine.

9 Claims, 3 Drawing Sheets

INVESTOR DOCUMENT CARRYING FOLDER

BACKGROUND OF THE INVENTION

The present invention concerns devices for safekeeping, carrying, organization and ready access to numerous financial documents in varied categories, and particularly to such documents which an investor naturally accumulates over an extended period of time, which may often be one to two years or more. The device can avoid the considerable waste of time and effort that can be required at brokerage firms in providing duplicate documents when an investor loses such documents as a result of inadequate home record keeping devices and procedures.

An individual investor who holds a number of investments over an extended period of time naturally accumulates varied financial documents, any of which may be important to the investor in making investment decisions, and in financial planning and tax return preparation. Typical categories of such documents include monthly account statements from the investor's brokerage firm, mutual fund statements, retirement account statements and summaries, year end tax reporting statements, stock purchase/sale confirmation slips, and various kinds of memoranda and reports, such as quarterly reports of corporations in which the investor holds stock. These documents may also include, for example, corporate notices about stock splits, rights offerings, tender offers, bond calls, and redemptions.

Many investors are naturally uncertain as to which of these numerous documents should be kept for an extended time, and which need not be. There is a need for a means to inform the investor as to which of such documents need be kept for future reference, and to assist the investor in maintaining the documents.

Many individual investors have no adequate record keeping and filing system at home for maintaining such a variety of documents in a readily accessible form. Even when needed documents can be found, often considerable searching is necessary, due to the haphazard nature of many personal home "filing" systems. Important documents often become lost, sometimes with serious consequences, and at minimum occasioning the considerable inconvenience of obtaining replacement copies, when this is possible, which often can involve extensive searching at an investment firm.

When the individual investor prepares to meet with a broker, accountant or other financial or tax advisor, typically at the office of the broker, accountant or other advisor, the investor attempts to gather up and bring those documents which might be needed during the meeting. But often the financial advisor may raise some additional issue which the investor had not considered while gathering the documents thought to be needed for the meeting, an issue requiring reference to documents left at home. This results in the inconvenience of further delay while the investor obtains the additional documents, and may require an additional meeting with the advisor at a later time. Moreover, if the investor is making investment decisions on a short time basis, requiring quick reaction to rapidly changing market conditions, such delays can be costly as well as inconvenient.

So there is a need for an easily carried device which can hold all of the kinds of financial documents which the investor is likely to need in making investment decisions, and in responsively communicating with a broker or other financial advisor.

There is moreover clearly a need for such a device which possesses a very readily understood means for organizing and labelling the various categories of financial documents involved, so that the investor will correctly file individual documents as they are received, and so that any particular document needed may be very quickly and easily retrieved, when the investor is meeting with a financial advisor, or needs to make quick reference to a document for any reason.

And there is obviously a need for such a device which allows an investor to carry such documents from place to place, for example between home and a broker's office, in a physically secure manner. That is, such a device which provides means for preventing any of the documents from inadvertently falling out of the device during transit between home and the brokerage firm.

Since the investor may be an individual who makes investment decisions and receives financial advice only on an infrequent basis, there is also a need for such a device which may be folded into a compact form for storage, and kept in a readily accessible and easily remembered place in the home during periods when the documents are not needed.

Because brokerage firms and other financial institutions may benefit from providing such a device to customers, in customer good will and by facilitating accessibility of customer documents needed during meetings of customers with advisors from said institutions, and by preventing the loss of documents, there is also a need for such a device which affords a means for an institution providing such a device for customers, to affix its name conspicuously to the device, for marketing purposes. The investor may show the device to friends who may be impressed by it, and possibly be more inclined to patronize an institution which provides such a helpful device to its customers.

Although various patents disclose containers for holding documents, as disclosed in the Information Disclosure Statement filed with the present application, none of these devices offer a combination of features suitable for meeting all of the needs described above.

To meet these needs, applicants' present invention provides a compactly foldable device in a notebook-binder format, having numerous labelled containments for described categories of documents, each adequate to hold numerous documents in a given category, which may be securely fastened when folded to prevent inadvertent loss of documents when being carried. The device may also be labelled on the front and on the spine with the name of the financial institution providing the device to a customer.

SUMMARY OF THE INVENTION

The invention is in the preferred embodiment a three part folding notebook for investors to store financial papers, the preferred embodiment having in the two outer sections flip-up pocket pages labelled for various categories of financial documents, having in the middle section a labelled pocket for other documents, such as account statements, which notebook is secured by a Velcro faster in compact form when closed. The invention offers large enough storage space for a wide assortment of investor papers, and is yet foldable into a compact, easily stored form. A company name and logo may be printed upon the cover and spine, and a business card window is attached to the back surface of the right section of the notebook, which surface faces forward when the right section is in the folded position.

The purposes of the invention which may be accomplished by its various embodiments include, but are not necessarily limited to, providing a device whereby an investor or other recipient of numerous and varied kinds of financial documents may (1) Readily, quickly and accurately file each such document in the proper containment section of the device; (2) Readily and quickly retrieve each such document from the device when needed; (3) Readily carry the documents from place to place in the device, for example when meeting with a financial advisor; (4) Carry such documents about without inadvertently dropping any of the documents from the device; and (5) Conveniently store the documents in a compact form within the device when they are not needed, being of such size and form as may be stood up on a desk or bookshelf or put into a normal size file drawer. In addition, the device has the purpose of allowing a financial institution to promote its name and good will by providing the device to customers with its name prominently displayed thereon.

DESCRIPTION OF THE PREFERRED EMBODIMENTS

Figure 1:
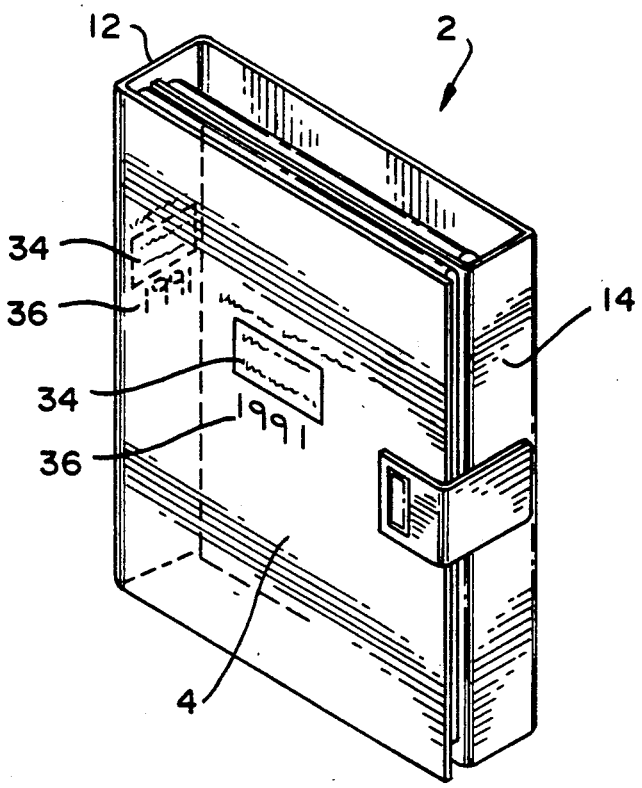
FIG. 1 is a perspective view of one embodiment of the device in the fully closed configuration.

Referring now to the drawings, in which like reference numbers denote like or corresponding elements, the invention has a binder 2, which is formed of vinyl-covered chipboard, to which a leather or leather-substitute outer cover may be added on the exterior surface 4. Alternatively the binder may be fabricated from heavy plastic sheets, instead of vinyl-covered chipboard. The binder 2 has three sections: a central section 6, a left section 8, which is to the left of central section 6 when one faces the open binder 2, and a right section 10, which is to the right of central section 6 when one faces the open binder 2. The central section 6, the left section 8, and the right section 10 are, are each formed of vinyl-covered chipboard, flexibly joined by vinyl, in a narrow stiff strip 12 and in another narrow stiff strip 14, along the side edges 16 of central section 6. Strip 12 is somewhat wider than strip 14. As may be seen from the figures, this construction allows the three sections to be folded together into a notebook-like form, in which configuration the strip 12 forms a large spine 12 of the binder 2, and strip 14 forms a small spine 14 which is to the right when binder 2 is closed.

Attached near the interior top portion 18 of binder 2, on its left section 8 and also on its right section 10, are a plurality of flip-up pocket pages 20. Each of flip-up pocket page 20 has a pocket 22, for holding financial documents. Each pocket 22 has a height sufficient to hold at least the major portion of a page, and has a depth (thickness) sufficient to hold at least about twelve to twenty pages of financial documents. Each of page 20 also has on the bottom thereof a colored title reference tab 24, bearing a short descriptive title of the subject matter category of financial documents to be inserted in the pocket 22 of that particular one of the flip-up pocket pages 20. The title reference tabs 24 may be located at various locations on the bottoms of the flip-up pocket pages 20, to suit the needs of various applications.

Figure 4:
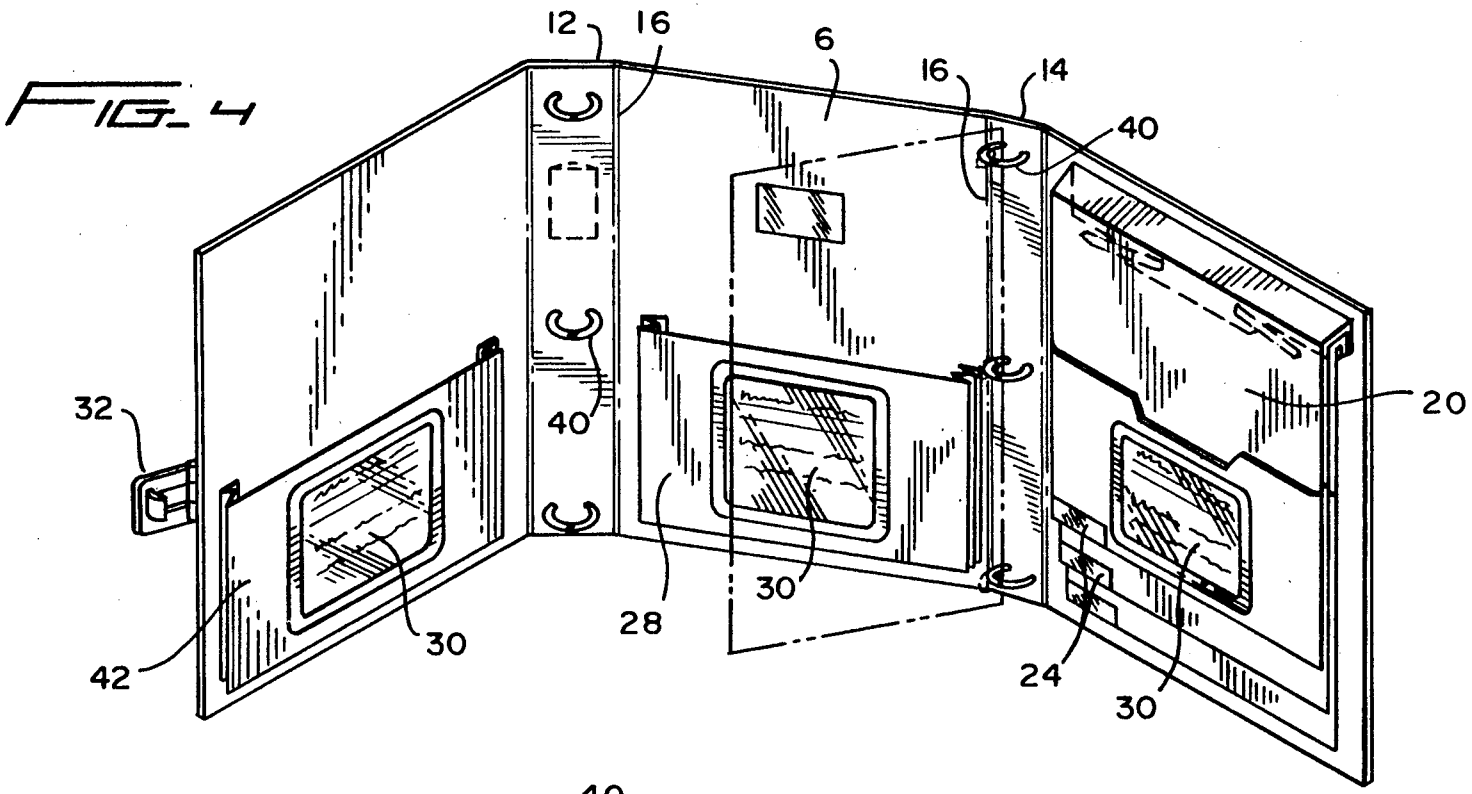
FIG. 4 is a perspective view of an alternate embodiment, in a fully open configuration.
Figure 5:
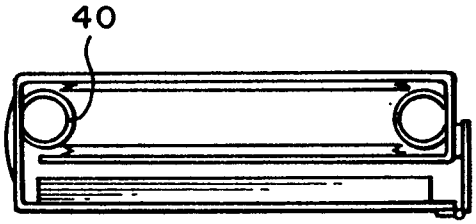
FIG. 5 is a view of the embodiment of FIG. 4, from above, in the fully closed configuration.

In the alternate embodiment of FIGS. 4 and 5, which has the flip-up pocket pages 20 only on right section 10 of binder 2, the heights of the flip-up pocket pages 20 are staggered, so that each colored title reference tab 24 is visible and not obscured by any of the flip-up pocket pages 20 above it, when the flip-up pocket pages 20 are lying flat. Such staggering could of course also be used in the first embodiment of the invention, for the flip-up pocket pages 20 on both sides of binder 2.

In both embodiments of the invention, the flip-up pocket pages 20 are attached to interior top portion 18 of binder 2, by means of metal tabs 26, which are bonded to left section 8, and to right section 10.

Attached to the interior of central section 6 of binder 2 is a fixed, expandable middle pocket 28, which may be used to hold financial documents of particular importance to the user, such as, for example monthly account statements from the user's brokerage firm. The middle pocket 28 is of sufficient thickness to easily hold up to about seventy pages of documents.

In both embodiments of the invention the pockets 22 of flip-up pocket pages 20 and middle pocket 28 are provided on the fronts thereof with filing instructions 30, which explain to the user which kinds of documents are to be filed in each of said pockets.

Figure 2:
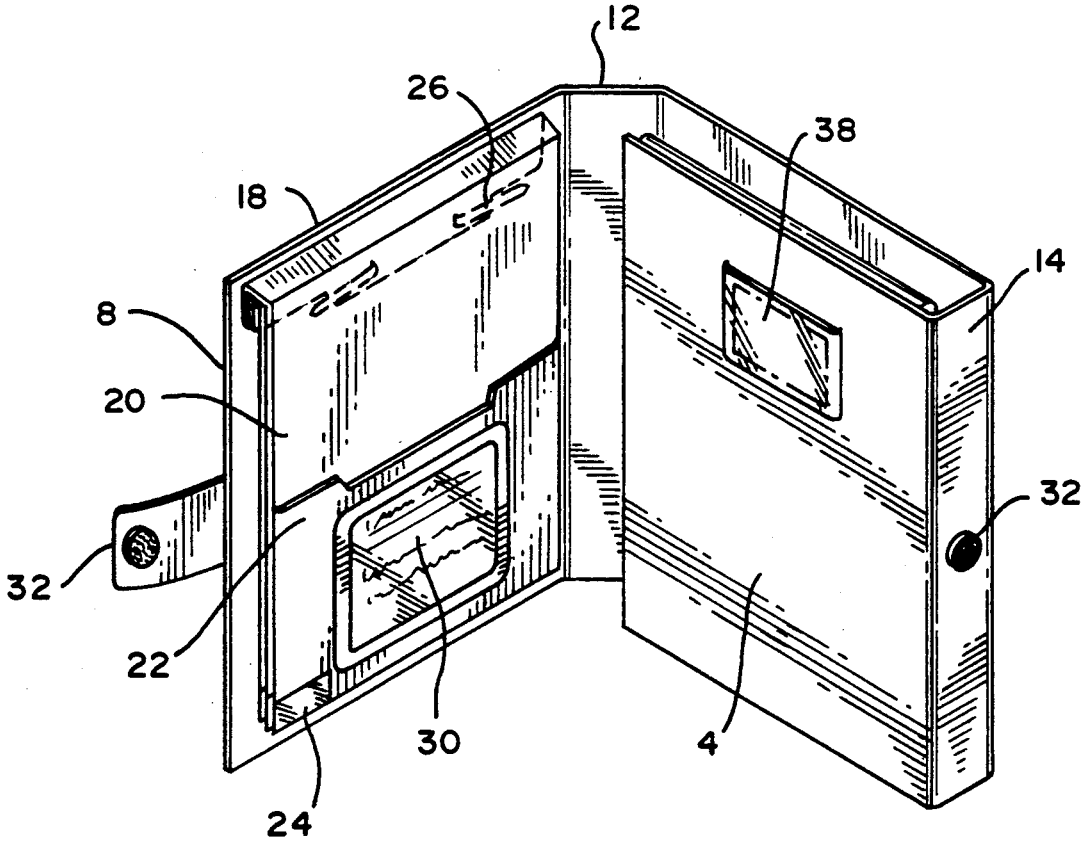
FIG. 2 is a perspective view of the embodiment of FIG. 1, in a partially open configuration.
Figure 3:
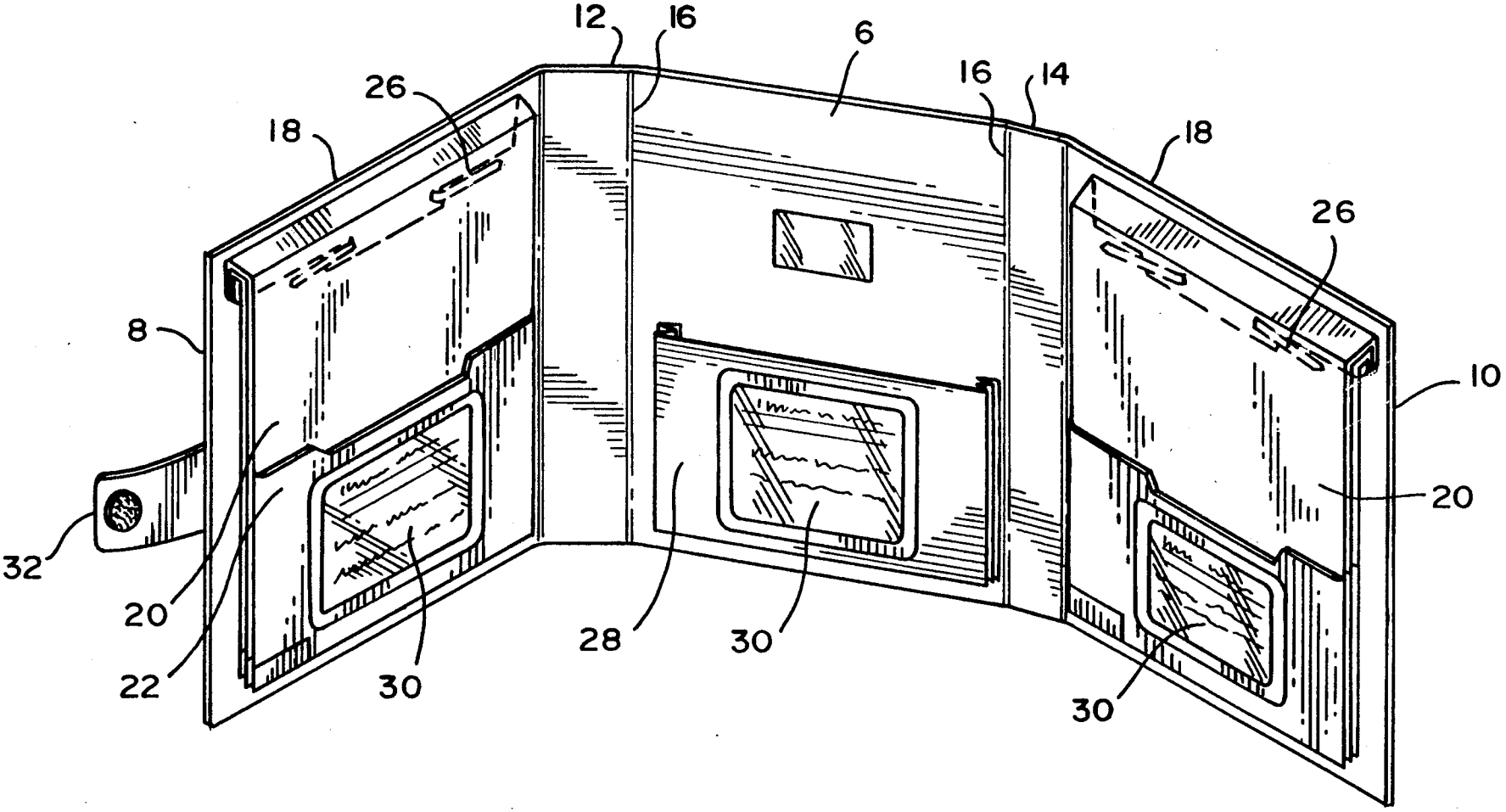
FIG. 3 is a perspective view of the embodiment of FIG. 1, in the fully open configuration.

In the first embodiment of FIGS. 1–3, there are three of the flip-up pocket pages 20 on each of the side sections 8 and 10, in addition to the middle pocket 28. Categories of documents for which labels have been provided for the pockets of the preferred embodiment are: account statements, year-end tax forms, purchase or sale confirmations, retirement account documents, research, mutual fund statements, and miscellaneous. Of course the needs of customers of various financial institutions may vary as to the categories which would be appropriate, and the invention could of course be fabricated with other suitable document category labels, as needed, and the number of pocket pages on each side could be varied as needed.

The binder 2 may be securely fastened when closed by means of a velcro fastener 32, having two sections attached to the exterior surfaces of left section 8 and right section 10 of binder 2.

Because of the sizes of the pockets 22 and 28, and particularly the fact that each pocket has sufficient height to hold a major portion of each document inserted in the pocket, and the fact that the binder 2 has hard sides formed by the sections 6, 8 and 10, when the binder 2 is securely closed and fastened, the financial documents carried within the device will not inadvertently be dropped from the device while the user carries it from place to place, for example when going to and from a meeting with a financial advisor. Thus the combination of the document pockets of the sizes indicated, the hard sides of the device, and the closure fastener constitutes a means for securing the documents against inadvertent loss while carrying the device from place to place.

Since a financial institution may wish to provide copies of the device to its customers, the institution will wish to also use the device as a marketing device. For this purpose, a company name and/or logo 34 may be printed in large size on the front of the exterior surface 4 of binder 2, and may also be printed in smaller size on large spine 12.

Since an investor with sufficient account activity may use different copies of the invention for different investment years, the investment year 36 may also advantageously be printed upon the large spine 12, for convenient reference in retrieving the proper set of investment documents. Or the year could conveniently be displayed in a card carried in a clear vinyl window attached to large spine 12, rather than being printed upon large spine 12.

The preferred embodiments also includes a clear plastic business card holder envelope 38, attached to the exterior surface 4 of binder 2 on right section 10, which may be used to hold the card of the user or his or her broker.

In the alternate embodiment of FIGS. 4 and 5, three notebook rings 40 are attached to each of the narrow strips 12 and 14, for holding financial documents or sheets of financial information, and an expandable pocket 42, of the same form as middle pocket 28, is attached to left section 8, instead of the flip-up pocket pages 20 of the first embodiment.

Those familiar with the art will appreciate that the invention may be employed in configurations other than the specific forms disclosed herein, without departing from the essential substance thereof.

For example, and not by way of limitation, although a velcro fastener 32 is used in the preferred embodiment to fasten the binder 2 in the closed configuration, any number of other types of fasteners could be used instead, such as, for example, a button-snap fastener, or a hook-and-eye fastener. A hook type fastener is indicated on the left side of FIG. 4.

Similarly, although the preferred embodiments have been designed for carrying investment documents, other kinds of documents, including, for example documents pertaining to real estate, insurance, education assessment and evaluation, and estate matters could advantageously be carried in a device of the form of the present invention.

Although the alternate embodiment of FIGS. 4 and 5 has multiple flip-up pocket pages 20 on right section 10 of binder 2, and has a single a single expandable pocket 42 on left section 8, it will be obvious that this configuration could be reversed, with multiple pocket pages on the left and a single pocket on the right section, without departing from the substance of the invention.

The scope of the invention is defined by the following claims, including also all subject matter encompassed by the doctrine of equivalents as applicable to the claims.

We claim:

1. Document carrying device, for carrying a plurality of financial documents in each of a plurality of subject matter categories of said documents, comprising:

(a) a folder, having an interior and an exterior, and having three hard flat sections, a central section and two outer sections each having a top and each having outer edges, and wherein said folder is foldable upon lines which are at least substantially parallel at each side of said central section;

(b) a plurality of pockets, connected to said folder, for insertion of said documents, and a label affixed at least in close proximity to each said pocket if not printed upon said pocket, said label indicating the subject matter category of said documents to be inserted within said pocket, and wherein each of said pockets has sufficient depth to hold at least about twelve to twenty pages of said financial documents, and has sufficient height to hold at least a significant portion of each page of said documents which are inserted in said pocket; and wherein each of said outer sections of said folder has attached to the interior surface thereof a plurality of pages bearing said pockets, each said page having a top, said pages being attached to each of said outer sections near said tops of said pages and near said tops of said outer sections of said folder; and wherein said central section of said folder has at least one of said pockets attached thereto; and (c) securing means, connected to said folder, for securing said folder in a closed, compact form, and for preventing any of said documents from falling out of said folder when said folder is carried by said user.

2. The device of claim 1, further comprising display means, attached to the exterior of said folder, for displaying information identifying at least one company which may be the company issuing said device, and for holding and displaying a personal business card.

3. The device of claim 2, wherein said securing means comprises the combination of said pockets, said hoard flat sections, and a fastening means attached to two portions of said exterior of said folder, for fastening said folder in a securely closed position when said folder has been folded into closed position.

4. The device of claim 3, wherein said fastening means is a pair of matching Velcro fastener sections, attached to said exterior of said folder on said outer two sections of said folder, near said outer edges of said outer sections of said folder.

5. The device of claim 2, wherein said display means comprises the printed name of said company on at least one portion of the exterior surface of said folder, and a transparent pocket attached to said exterior of said folder, of a size sufficient to hold a business card.

6. The device of claim 2, wherein each of said pages bearing said pockets has affixed near the bottom of said page a color coded label bearing a short title for the category of documents to be inserted in said pocket of said page, and wherein said pages are sized in staggered fashion such that all of said color coded labels are visible when said pages are laid flat.

7. The device of claim 2, wherein said central section of said folder has one of said pockets attached thereto, and wherein said pocket attached to said central section of said folder has a thickness sufficient to hold at least about seventy pages of said documents.

8. Document carrying device, for carrying a plurality of financial documents in each of a plurality of subject matter categories of said documents, comprising:

(a) a folder, having an interior and an exterior, and having three hard flat sections, a central section and two outer sections each having a top and each having outer edges, and wherein said folder is foldable upon lines which are at least substantially parallel at each side of said central section;

(b) a plurality of pockets, connected to said folder, for insertion of said documents, and a label affixed at least in close proximity to each said pocket if not printed upon said pocket, said label indicating the subject matter category of said documents to be inserted within said pocket, and wherein each of said pockets has sufficient depth to hold at least about twelve to twenty pages of said financial documents, and has sufficient height to hold at least a significant portion of each page of said documents which are inserted in said pocket; wherein a first one of said outer sections of said folder has attached to the interior surface thereof a plurality of pages bearing said pockets, each said page having a top, said pages being attached to said outer sections near said tops of said pages and near said top of said outer sections of said folder; and wherein a second one of said outer sections of said folder and said central section of said folder each has at least one of said pockets attached thereto; and (c) securing means, connected to said folder, for securing said folder in a closed, compact form, and for preventing any of said documents from falling out of said folder when said folder is carried by said user.

9. The device of claim 8, wherein said central section of said folder and said second outer section of said folder each have one of said pockets attached thereto, and wherein said pocket attached to said central section of said folder and said pocket attached to said second outer section of said folder each have a thickness sufficient to hold at least about seventy pages of said documents.

* * * * *